US010189068B2

(12) United States Patent
Woidasky

(10) Patent No.: US 10,189,068 B2
(45) Date of Patent: Jan. 29, 2019

(54) BENDING PRESS

(71) Applicant: Bystronic Laser AG, Niederoenz (CH)

(72) Inventor: Lars Woidasky, Gotha (DE)

(73) Assignee: BYSTRONIC LASER AG, Niederoenz (CH)

( * ) Notice: Subject to any disclaimer, the term of this patent is extended or adjusted under 35 U.S.C. 154(b) by 607 days.

(21) Appl. No.: 14/902,000

(22) PCT Filed: Aug. 5, 2014

(86) PCT No.: PCT/IB2014/063707
§ 371 (c)(1),
(2) Date: Jan. 5, 2016

(87) PCT Pub. No.: WO2015/019285
PCT Pub. Date: Feb. 12, 2015

(65) Prior Publication Data

US 2016/0151820 A1 Jun. 2, 2016

(30) Foreign Application Priority Data

Aug. 9, 2013 (EP) ..... 13179819

(51) Int. Cl.
*B21D 5/01* (2006.01)
*B21D 5/02* (2006.01)
(Continued)

(52) U.S. Cl.
CPC ..... *B21D 5/0272* (2013.01); *B21D 5/002* (2013.01); *B21D 5/02* (2013.01); *B21D 5/0209* (2013.01);
(Continued)

(58) Field of Classification Search
CPC ..... B21D 5/02; B21D 5/0209; B21D 5/0281; B21D 11/22; B21D 43/003; B21D 43/26; B21D 5/002; B21D 5/0272
(Continued)

(56) References Cited

U.S. PATENT DOCUMENTS 4,488,237 A * 12/1984 Aronson ..... B21D 5/004 33/706
5,761,940 A * 6/1998 Moore, Jr. ..... B21D 5/002 72/19.4
(Continued)

FOREIGN PATENT DOCUMENTS

DE 3830488 A1 3/1990
DE 4442381 A1 5/1996
(Continued)

OTHER PUBLICATIONS

International Search Report and Written Opinion of the ISA, dated Jan. 21, 2015 from parent International Application PCT/IB2014/063707 published WO2015/019285A1 on Feb. 12, 2015; with partial translation.
(Continued)

*Primary Examiner* — David B Jones
(74) *Attorney, Agent, or Firm* — Nadya Reingand; Yan Hankin

(57) ABSTRACT

The invention relates to a bending press (1) for bending workpieces, comprising an upper tool (2) and a lower tool (3), a tool holder (4), in which the upper tool (2) is inserted, and a tool holder (5), in which the lower tool (3) is inserted, wherein the upper tool (2) and the lower tool (3) can be fixed in various positions within the respective tool holder (4, 5), a control device (13) for controlling the bending press (1), a sensor device (8), which is connected to the control device (13), and a stop (6) for positioning the workpiece within the bending press (1), wherein the stop (6) can be moved in
(Continued)

relation to the tools (2, 3) by means of a drive (9) controlled by the control device (13). The sensor device (8) is designed to detect the position of the upper tool (2) and of the lower tool (3) within the bending press (1) without contact, and the control device (13) is designed to adapt the movement process by means of which the stop (6) is positioned in relation to the tools (2, 3), in dependence on the position of the upper tool (2) and of the lower tool (3) detected by means of the sensor device (8).

20 Claims, 8 Drawing Sheets

(51) Int. Cl.
*B21D 11/22* (2006.01)
*B21D 43/00* (2006.01)
*B21D 43/26* (2006.01)
*B21D 5/00* (2006.01)

(52) U.S. Cl.
CPC ..... *B21D 5/0281* (2013.01); *B21D 11/22* (2013.01); *B21D 43/003* (2013.01); *B21D 43/26* (2013.01)

(58) Field of Classification Search
USPC ..... 72/20.2
See application file for complete search history.

(56) References Cited

U.S. PATENT DOCUMENTS

| | | | | |
|---|---|---|---|---|
| 5,969,973 | A * | 10/1999 | Bourne | B21D 5/02 700/165 |
| 5,983,688 | A | 11/1999 | Anzai et al. | |
| 6,243,611 | B1 * | 6/2001 | Hazama | B25J 9/1666 700/104 |
| 6,644,080 | B2 * | 11/2003 | Lindstrom | B21D 5/002 72/19.4 |
| 6,922,903 | B2 * | 8/2005 | Horn | B21D 5/002 33/1 N |
| 7,818,985 | B2 * | 10/2010 | Ikeda | B21D 5/02 100/257 |
| 8,931,317 | B2 * | 1/2015 | Ikeda | B21D 5/0281 72/18.2 |
| 2006/0042339 | A1 | 3/2006 | Denkmeier | |
| 2013/0160508 | A1 | 6/2013 | Fischereder et al. | |
| 2013/0327104 | A1 | 12/2013 | Haselboeck | |
| 2014/0132720 | A1 | 5/2014 | Rogers et al. | |

FOREIGN PATENT DOCUMENTS

| | | | |
|---|---|---|---|
| EP | 1600256 | A1 | 11/2005 |
| EP | 0919300 | B1 | 6/2006 |
| EP | 1510267 | B1 | 11/2006 |
| EP | 1517761 | B1 | 11/2006 |
| JP | H09-052124 | A | 2/1997 |
| WO | 2012/016252 | A1 | 2/2012 |
| WO | 2012/103565 | A1 | 8/2012 |
| WO | 2014/074480 | A2 | 5/2014 |

OTHER PUBLICATIONS

PCT Written Opinion of the ISA, dated Jan. 21, 2015 from parent International Application PCT/IB2014/063707 published WO2015/019285A1 on Feb. 12, 2015; English (full) translation by the IB dated Feb. 9, 2016.

EPO search report and written opinion from priority EPO application EP13179819, dated Nov. 13, 2013 (in German).

* cited by examiner

BENDING PRESS

This application is a 35 U.S.C. 371 national-phase entry of PCT International application no. PCT/IB162014/063707 filed on Aug. 5, 2014 and also claims benefit of priority to prior European (EPO) application no. 13179819 filed on Aug. 9, 2013, and parent PCT International application no. PCT/IB2014/063707 is expressly incorporated herein by reference, in its entirety and as to all its parts, for all intents and purposes, as if identically set forth in full herein.

TECHNICAL FIELD

The present disclosure relates to bending presses and methods for bending workpieces using bending presses.

BACKGROUND

The selection and arrangement of workpieces in bending presses, also called press brakes or bending machines, is typically accomplished to a high degree manually, and only partly assisted by the machine control. To this end, a bending plan is created which calculates the product-specific upper and lower tools and their theoretical position. However, there is no monitoring as to whether these tools are or were actually inserted into the machine. Furthermore, the tools can be introduced at positions which do not correspond to the process and comprise a potential hazard.

However, the exact position of the tools is required to perform high-quality bending sequences and to align the back stop fingers or a robot accordingly. A corresponding positioning is only possible by precise and work-intensive measurement by hand, and transfer to the machine control.

Inaccurate positionings, non-allowance in the bending plan or an incorrect number of tools can result in damage to machine and peripheral. This is also possible as a result of an incorrect choice of tool geometry. Furthermore, upper and lower tools with maximum loads are defined—here also incorrect handling can result in damage. Damage caused by incorrect insertions on press brakes and tools can additionally lead to demands of any kind with respect to the manufacturer. Apparatuses are already known which attempt to solve these problems, in part, but have a number of disadvantages. Thus, for example, a display device on the machine can merely predefine a desired position but not monitor and detect this.

Published patent application JP H09-052124A discloses a bending machine with upper and lower tool, a stop and a barcode reader which is disposed on the stop. Upper and lower tool are each provided with a barcode on their rear side which can be read out by the barcode reader. The barcode contains information about the condition of the tool. This information is transferred to an NC controller. In addition to the barcode reader, a contact sensor or end switch is provided on the stop by which of which the dimensions of the respective tool can be determined. Such a procedure is complex and time-consuming since the contact sensor must be moved several times and in different positions directly onto the tool.

With such a system, for example, tools on the outer sides of the machine cannot be detected since no (rear) stop can travel here as a result of the mechanism. In addition, only individually positioned tools can be detected. A plurality of tools pushed together (or arranged in a row) on a tool holder cannot be distinguished since the central tools cannot be detected by the known system as such. In particular, individually positioned tools can only be detected when the distances between the tools are sufficiently large in order that the rear stop or the fingers can travel in between. A barcode requires a relatively large amount of space, so that such a barcode cannot be shown on very small punches (upper tool) and dies (lower tool). In addition, the detection of the barcode on sloping surfaces of the tool is very liable to error so that not all tools can be reliably detected. Also, specially shaped tools cannot be detected if the rear stop cannot be moved mechanically between the tools. If the approximate position of the tool is not known before the detection process, there is a high risk of a collision with the rear stop. Since the workpieces to be processed also impact against the rear stop during positioning, the contact sensors are severely stressed and are easily damaged.

WO 2012/103565A1 discloses a method for equipping a bending press with a bending tool. Here a controlled handling device with a gripper is used for the bending tool. A control device generates control commands in order to move the tool from an actual position into a desired position when inserting into the tool holder. Only when the tool has reached the desired position, is it inserted in the tool holder and fixed there. The tools held by the handling device must be approached directly by the (rear) stop in order to determine their actual position. The method is complex and based on the basic principle that the tools inside the tool holder must adopt an exact position so that the desired bending plan can be carried out.

EP 0919300B1 discloses a bending machine in which the upper tools are provided with barcodes. A guide running in the Z direction for a scanner for reading the barcode is provided on the tool clamp for the upper tools on the side facing the operator. A linear scale, e.g. magnetic scale as position detection device is further provided on this tool clamp on the side facing the operator. The position data of the upper tools detected by the scanner are stored and made available again subsequently in a display. For producing the same product again, using the stored data the operator must place the tools precisely by hand according to the stored position. This bending machine is also based on the basic principle that the tools must adopt an exact position inside the tool holder so that the desired bending plan can be executed. However, the exact positioning and adjusting of the tool position requires high expenditure of time and personnel.

EP 1517761B1 relates to special tools and tool holders which can detect tool positions relatively imprecisely by means of sensors. In this case, it is not possible in some cases to classify tools qualitatively and geometrically. In addition, the high acquisition costs of the required peripherals, the maintenance intensity, the necessary new acquisition of special punches and dies and their restricted geometry are disadvantages. Furthermore, as a result of the sensors introduced into the machine and tool, limiting pressing forces are to be expected. In addition, movable sensors on upper and lower beams as well as necessary data and supply cables reduce the variability of a press brake. The number of possible bending parts is limited.

EP 1510267B1 discloses a method for displaying a tool arrangement in a press brake. On the basis of a displayed diagram it is determined whether the planned bending process is possible. Subsequently further tools are added for specific bending line sections and the process is repeated with the new arrangement. This process requires an exact positioning of the tools in the tool holder precisely as the previous method.

DE 3830488A1 discloses an electronic tool recognition system for press brakes. By means of this system it is possible with the aid of an electronic control to recognize the built-in tool geometry, to protect the tools against overloading and ensure the working safety for the operator.

DE 4442381A1 relates to an apparatus for position and shape recognition of upper beam tools on swivel bending machines and press brakes. Located behind the upper beam in a guide is a motor-displaceable slide on which a holder for a laser light curtain is mounted. With this the length of the built-in upper beam tools and their intermediate spaces are determined. The values are displayed numerically and graphically. In addition, a write-read head which reads out codes on the rear side of the upper beam tools is located in the holder.

All the known systems relate to the readout of codes and/or the detection of tool dimensions. The precise positioning of the tools inside the tool holder plays an essential role. In the prior art therefore it is necessary to position the tools exactly in relation to the tool holder, which brings with it the disadvantage of a complex and time-intensive equipping of the bending machine.

SUMMARY

It is therefore an object within the scope of the present disclosure to eliminate the disadvantages of known solutions, and provide a bending press in which an exact positioning of upper tool and lower tool is no longer required. Despite this, the entire bending process, including the positioning of the workpiece relative to the tools should be reliable and deliver bending parts exactly to bending plane.

The object may be achieved by features disclosed within the present disclosure.

A sensor device is configured to detect the position and/or the type of the upper tool and of the lower tool within the bending press without contact, and the control device is configured to adapt the movement process by which the at least one stop is positioned relative to the tools depending on the position and/or type of the upper tool and the lower tool detected by the sensor device.

An important advantage lies in that the tools no longer need be positioned exactly within the tool holder when equipping the bending press. As a result, expenditure of time and personnel may be saved. The scope of the present disclosure encompasses the principle that not the tools (nor their position within the tool holder) are adapted to the bending plan, but that the movement processes of the at least one stop are adapted to the position of upper and lower tools within the bending press or within the respective tool holder. As a result, a highly flexible system is created that automatically regulates the movement processes of the stop required before and during the bending process.

Initially, the position of the tool already inserted into the tool holders is detected relative to the (or in) the tool holder. Depending on this relative tool position, an automatic adaptation of those movement processes with which the stop/stops (e.g., rear stops) is/are positioned is then made. A 'non-exact' insertion of the tool into the tool holder or an insertion at a completely different place is thereby automatically 'compensated' or taken into account. In fact, according to the invention there is no 'incorrect' insertion or positioning. Any arbitrary position of upper and lower tool in the tool holders results in an automatic adaptation of the stop control, and a correct bending result. To this end, a bending program is stored in the control device that takes into account the position data of upper and lower tools detected by the sensor device, as input quantity, and generates control commands to the drive of the stop as output quantity depending on this input quantity.

'Movement process of the stop' or 'movement of the stop' should be understood as meaning within the present text any feasible movement of the stop in particular of its stop elements such as stop fingers and the like.

With the non-contact sensor device, in particular configured as a camera, a plurality of tools distributed along the Z-axis and inserted in the tool holder could also be detected. An automatic determination of the gap width between two neighbouring upper or lower tools would also be feasible. If the coverage of the sensor device is sufficiently large, all the tools in a single holder may be recorded. In the case of smaller coverage, the camera may then be displaced so that the individual tools along the Z-axis may be detected consecutively.

In one version, the detection of the tool data may be made by the sensor device firstly independently, or the position, or of the presence at all, of a (rear) stop. A stop could thus be mounted or inserted only after the detection step. In a further version, other or additional tool data could be detected which are not used to correct the stop, but serve other purposes.

Preferably, the at least one stop for positioning the workpiece is a rear stop that may be moved parallel to the bending line, and the sensor device is disposed in the region of the rear stop. At this point, the coverage of the sensor device is not disturbed by operating staff and workpieces to be inserted. Also, this arrangement of the sensor device does not restrict the working range of the bending process. The sensor is additionally well-protected, and as a result of its arrangement, can deliver reliable images of the rear side of the tools.

Preferably, the sensor device is disposed on the stop, for example on the rear stop, and can be moved together with the stop preferably parallel to the bending line. The axis of travel of the stop, for example rear stop, is thereby used in two respects. In addition, other movement directions of the stop may also be controlled (adapted to the position of the tools). The (rear) stop could, for example, be movable in three different spatial directions.

The arrangement of the sensor device, in particular in the form of a read head or a camera on a guide of the rear stop or directly thereon, offers the following advantages: simple arrangement; no additional perturbing contours on the outer side of the machine; no hindrance of the bending process or personnel; the external appearance of the machine does not change for the user; the sensor device can be simply retrofitted and also allows the simultaneous read-off of upper tool (punch) and lower tool (die); the sensor device is protected with regard to contamination; a plurality of tools can be identified simultaneously along the Z-axis; and, the sensor device can be positioned arbitrarily. In addition, the position of the tools could also be calculated via the reference position of the rear stop along the Z-axis.

Preferably, the sensor device may be moved into a position in which the detection range of the sensor device covers both the upper tool and also the lower tool, at least in part. As a result, all the required data may be recorded by a single measurement process or a single image recording. As a result of the large detection range, only one sensor device is required.

In a further version, the sensor device includes at least two non-contact, in particular optical sensors with different spatial detection ranges. The movement of a sensor, for example along a bending line may thus be omitted. The detection ranges of the sensors can thereby overlap.

In a preferred version, the bending press includes an operator interface, in particular in the form of a screen, where sensor data of the sensor device and/or data derived from the sensor data can be presented on the operator interface (or output, during operation, automatically to the operator interface). It is preferable if the sensor device includes at least one camera, and the images or image sequences recorded by the camera are shown on the screen for the operator.

Preferably, the sensor device is a camera, particularly preferably a matrix camera. Thus, not only codes or scales may be detected but—in particular, when these are absent—the tool itself or its contours. Thus, a plurality of different information may be recorded via a single measurement/image recording.

Preferably, a scale or a position marking is attached to the upper tool and/or the lower tool and/or the respective tool holder. This enables a reliable and exact determination of the relative position of tool to tool holder.

Preferably a two-dimensional code, in particular a data matrix code, is attached to the upper tool and/or the lower tool, wherein preferably the code contains information about the tool used, in particular about type and dimensions of the tool. Data matrix codes have some advantages for this application, for example, they allow a sloping read-off of the code. As a result, if the camera has a sufficiently large reading window, codes of upper tools and lower tools may be evaluated simultaneously. It is also possible to attach the code to sloping surfaces. Furthermore, the type of coding allows a relatively larger error tolerance, that is, in the case of damage the code is still recognized. As already mentioned, extremely small code dimensions may also be read from a relatively large distance. Advantageously, a code is attached to each of the front and the rear side of the tools in order to enable a detection of the corresponding tool even during rotation of the tool (mirrored introduction).

The present disclosure encompasses methods for bending a workpiece using a bending press according to any one of the preceding versions. This process includes the steps of:

- detecting the position and/or type of the upper tool and/or lower tool that are fixed in the respective tool holders within the bending press via the sensor device,
- adapting the movement process by which the at least one stop is positioned relative to the tools depending on the position and/or type of the upper tool and/or lower tool detected via the sensor device,
- positioning the at least one stop according to the adapted movement process by adjusting the stop by a drive controlled by the control device relative to the tools,
- performing a bending process by relative movement of upper tool and/or lower tool.

This involves a flexible system that makes it possible to implement a specific bending plan independently of the position of the inserted tool. By adapting the controlled movement processes of the stop, the system is flexibly set to any tool position.

Preferably, during the step of detecting the position and/or the type of upper tool and/or lower tool, its position relative to the respective tool holder in which the tool is fixed is detected. This is a particularly reliable method since due to the spatial proximity of tool and tool holder, these can easily be detected and recorded in one recording.

Preferably, during the step of adapting the movement process, a displacement path of the stop parallel to the bending line is calculated. The stop is, as it were, 'tracked' to the tools. The displacement path is, here, the output quantity, while the position data of the tools constitute the input quantity of the bending program.

Preferably, before and/or during the step of detecting the position and/or type of upper tool and/or lower tool, the sensor device is moved parallel to the bending line. As a result, tools may be detected in terms of position along the entire length of the bending press.

Preferably, the position and/or the type of the upper tool and the position and/or the type of the lower tool are detected simultaneously. To this end, the detection range of the sensor device covers both upper tool and also lower tool or optionally their tool holders.

Preferably, the position of the upper tool and/or the lower tool is detected with the aid of a scale or position marking attached to the upper tool and/or the lower tool and/or the respective tool holder. As a result, the accuracy of the position detection is increased. Size and shape of the tools may also be detected in relation to the scale or at a distance from the camera.

Preferably, the detection of the position and/or detection of the type of upper tool and/or lower tool is made by a contour recognition of the tool. Here, the position of the tool, for example in relation to the (known) position of the sensor device, can be determined independently of aids such as scales or codes. The camera is in a position to recognize the contours of the inserted tools and compare them with stored data (e.g., in the control device). If no data are stored or no codes are available at all, the tools are identified by means of their geometry and assigned accordingly.

Preferably, the method includes a step of reading out information of a two-dimensional code, in particular a data matrix code, applied to the upper tool and/or the lower tool. By using a data matrix code, it is also possible to mark extremely narrow tools.

The simultaneous identification of several codes is also possible. By linking the camera to the rear stop, the distance from the tools may be varied. According to the resolution of the camera, a plurality of codes and contours may thus be identified simultaneously.

The present idea is based on the fact that the inserted tools are identified in their position (optionally also in their type). The parameters thus determined are used via the machine control in such a manner that the peripheral equipment of the machine is adapted to the present bending process. Here, for example, mention should be made of the rear stop, it is then positioned in relation to the tools.

As a result, both the measurement and also the monitoring between an actual value and a desired value are saved—the tools may be inserted at any arbitrary position and the bending process can readily be started. Among other things, it is therefore no longer necessary to achieve exactly the same tool and workpiece positions for a recurring bending part. As mentioned, it is unimportant at which position the tools are located at all. By identification and conversion to the product, all relevant machine parts (stops) are positioned accordingly, and at the same time, a collision during the bending process is eliminated.

In a preferred version, upper tool (punch) and lower tool (die) are identified simultaneously. The position of these tools with respect to one another can be safety-relevant and important for the quality of the bending. Safety-relevant means in this case, that an incorrectly positioned upper tool can result in a collision. Thus, a monitoring between upper and lower tools corresponding to the bending process can be performed simultaneously. An incorrect insertion is thereby eliminated.

The disclosure also relates in one version to the determination of type of tool and tool position of all upper tools (bending punches) and all lower tools (dies) within a bending press or bending machine.

In order to determine type of tool (including all its describing parameters) and exact Z-direction position in the bending process, 2D codes (preferably data matrix codes) and a read head should be used. For this purpose, the read head, preferably a matrix camera, is fastened to a Z-axis of the rear stop of the bending press, with the result that it is automatically adjustable. As a result of the relatively small dimensions of this camera and a cable chain that is already present on the axis, both installation and also the data transmission may easily be implemented.

In order to describe the parameters, a specific data matrix code is applied to each tool present. This code, for example, records a simple number which in the database can be assigned with the necessary parameters of the tool. This includes, for example: geometry, maximum load, material, number of bending cycles already performed, wear, etc. By means of a description in terms of simple numbers, the data matrix codes can also be prepared in the smallest design and thus enable an application to extremely narrow tools (punch and dies).

A possible sequence could appear as follows. After introducing the tools into the bending press, upper tool (punch) and lower tool (dies) are clamped, and are therefore now fixed in their position. Then, the (matrix) camera travels with the Z-axis over the entire length of the bending press. In so doing, depending on the reading speed of the camera, images of the tools are produced and evaluated by means of the machine control and database. The identification of the position of the inserted tools is made possible or simplified by a simple scale—attached to the tool clamping of the machine—preferably directly at or on the same height of the data matrix code. The scale is then part of the image produced and thus enables a precise determination of position.

Further possible advantages of versions within the scope of the disclosure are listed hereinafter:

- complete monitoring of the inserted tools
- the bending plan may be converted automatically to real tool positions
- significantly shorter downtimes of the bending press during a tool change since an exact measuring can be omitted,
- the risk of overloading the bending press and tool is significantly minimized,
- compared to known solutions, extremely low-maintenance and inexpensive,
- all or different tools may be used (regardless of geometry, manufacturer or type of clamping),
- retrofitting of already existing tools is possible,
- as a result of the non-contact measurement principle, the tools are not restricted in their maximum loading,
- contaminated or damaged codes are simply cleaned or re-applied,
- no additional perturbing contours on the bending press or chains for data cable,
- the data matrix codes applied to the tools may simplify the storage; also, corresponding storage places or maximum usage times of the tools or the like may be recorded in the description of the code;
- retrieving bending parts and programs: with the aid of the (matrix) camera, codes may also be read from working plans or sheets which for example stand for a certain sequence, a corresponding program, or a sheet quality.

In addition, the camera employed can visualize the (rear) stop region. Frequently, it is difficult to position sheets precisely at the rear stop fingers, since the installation height of the bending press is too low, or the inserted tools hinder the view of the stop fingers. To simplify the sequence, the camera image that shows the rear stop region can here be transferred to a screen visible for the operator.

Preferably, it is displayed at an operator interface if the position of the upper tool and/or the lower tool detected by the sensor device is incorrect, in particular if the tools are not aligned with one another. In this case, correction values relating to the positioning of upper tool and/or lower tool can be transferred to the control or the operator interface (e.g. image) in order to display to the operator that the tools are not aligned and the position of at least one tool must be corrected.

Preferably the bending process or the setting up process is interrupted if the position and/or type of the upper tool and/or the lower tool detected by the sensor device is not correct. In the case of incorrectly placed or incorrectly dimensioned tools, damage to the machine or hazards for the operating staff due to tool rupture may be eliminated in this way.

Preferably, the method includes a calibration of the position of the stop, wherein preferably the calibration is performed by a preferably optical position mark that is attached to a component of the bending press or to a reference tool. The calibration of the (rear) stop can be made in the X, R and Z directions by an optical reference (position marking) on the upper beam, on the tool clamp, within the bending press or by a reference tool, so that an alignment of the (rear) stop by hand may be omitted if the stop has been shifted due to incorrect use.

Preferably, the workpiece to be bent is provided with a read-out code that contains a reference to an appurtenant bending program and that after reading out the code, preferably by the sensor device, the appurtenant bending program is automatically loaded in the control device and/or executed. Thus, a loading of the bending program pertaining to the bending part into the control may be accomplished automatically by means of a code on the bending part (bending or sheet blank) in which the appurtenant bending program is encrypted. The code is, for example, applied to the bending part by means of a laser. The operator for example holds the sheet in front of the sensor device, for example a camera, and the control automatically loads the corresponding program. The code may also be read out during positioning of the bending part on the stop, advantageously automatically by the sensor device.

Preferably, the sensor device is a camera and the images or image sequences recorded with the camera are displayed at an operator interface. The transfer of the live camera image to the control or the operator interface enables the operator to display the actual situation inside the bending press.

This version enables, inter alia:

- operator guidance of the sheet before or during contact of the sheet at the stop by means of camera image and faded-in guide lines (similarly as during parking with a car);
- operator guidance during insertion of the tools by means of camera image and faded-in guide lines;
- identification of contact of the sheet on the (rear) stop by means of camera. (If the camera identifies that the sheet has been correctly positioned on the stop, the control outputs a corresponding signal and the operator can start the bending process).

a monitoring of the machine space by the camera. This can be used to monitor the approach speed of the stop to the table and this can thus be moved faster than in conventional bending processes.

A measurement of the bending of upper and lower beam may also be made with the sensor device. During the bending process, upper and lower beam undergo a bending that can be compensated by camber cylinders. The crowning is calculated in the control by employed theoretical values, and should be calculated in future by reference to the real state recorded by the sensor device. As a result, a higher accuracy can be achieved in the bent part.

The sensor device can also be configured to detect the (sheet) thickness of the inserted (sheet) workpiece. If the workpiece corresponds to the input data in the control device (machine control) or the corresponding values vary within the stipulated tolerance range, the bending process may be started or continued. Otherwise, the bending process may be discontinued or interrupted.

Likewise, workpiece or bending part dimensions (correct cutting, correct positioning) may be detected with the sensor device, thus enabling an improved operator guidance.

In a preferred version, the specific method also includes the creation of thermographic images of the bending press or of parts thereof. This is preferably accomplished by at least one IR sensor or at least one thermal image camera that can be disposed inside the bending press. Thus, the various heating states of the bending press (e.g., the tools, the machine frame, etc.) may be monitored and evaluated. As a result of the heating, the machine body expands in an undefined manner in some cases, which results in displacements of important reference points and therefore in inferior bending results. Particularly critical is an incompletely heated-through machine body, that is, local temperature differences such as can occur, for example, directly after switching on the bending press. With the aid of the thermographic state images, individual reference axes can compensate for the displacements which occur and thus ensure a uniform bending quality.

Further advantages, features and details according to the present disclosure are derivable from the following description in which exemplary versions of the invention are described by reference to the drawings. In this case, the features mentioned in the totality of the description and drawings may possibly each be understandable as inventive individually by themselves, or in any combination.

BRIEF DESCRIPTION OF THE DRAWINGS

The appended list of reference labels is part of the disclosure. The figures are described cohesively and comprehensively. The same reference numbers means the same components, reference numbers with different indices indicate components that have the same function or are similar.

In the figures.

DETAILED DESCRIPTION

Figure 1:
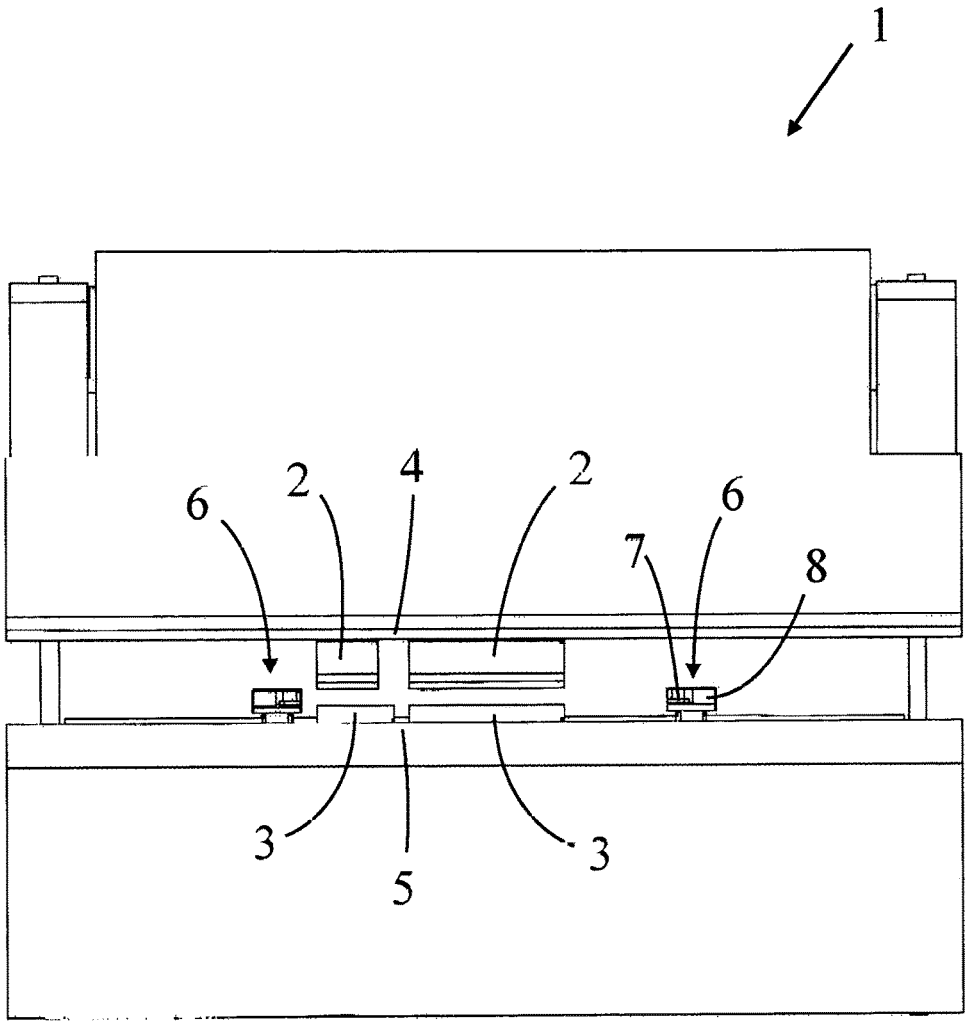
FIG. 1 depicts an exemplary bending press from the front.
Figure 6:
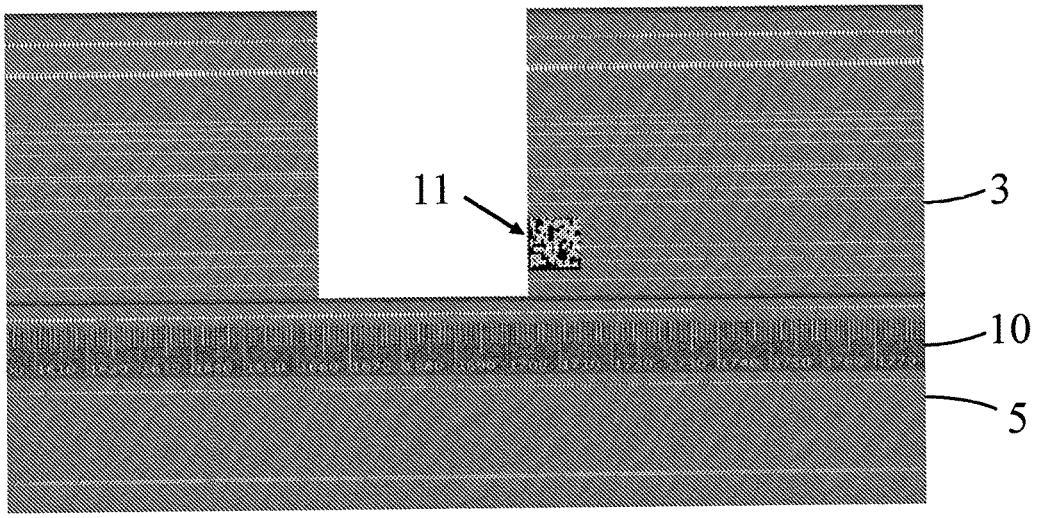
FIG. 6 depicts two lower tools which are fixed in a tool holder.

FIG. 1 depicts a bending press 1 for bending workpieces including an upper tool 2 (punch) and a lower tool 3 (die), a tool holder 4 in which the upper tool 2 is inserted and a tool holder 5 in which the lower tool 3 is inserted. The length of the tool holders 4, 5 along the Z-axis, that is, parallel to the bending line, is so great that a plurality of upper and lower tools 2, 3 may be inserted and fixed adjacent to one another in the tool holder 4, 5. This case is shown in FIG. 6 where two lower tools 3 sit in the tool holder 5.

The upper tool 2 and the lower tool 3 can be fixed in various positions inside the respective tool holders 4, 5. That is, the tools can be arranged differently relative to the respective tool holder in the direction of the Z-axis.

The bending press 1 has at least one stop 6 for positioning the workpiece 14 (FIG. 2) inside the bending press 1, where the stop 6 can be moved by means of a drive 9 controlled by a control device 13 (shown in FIG. 8) relative to the tools 2, 3. This movability relates in particular to a movability along the Z-axis but a movability in other—in particular perpendicular thereto—spatial directions is also feasible. The exemplary version from FIG. 1 shows two stops 6 that are movable independently of one another.

Figure 2:
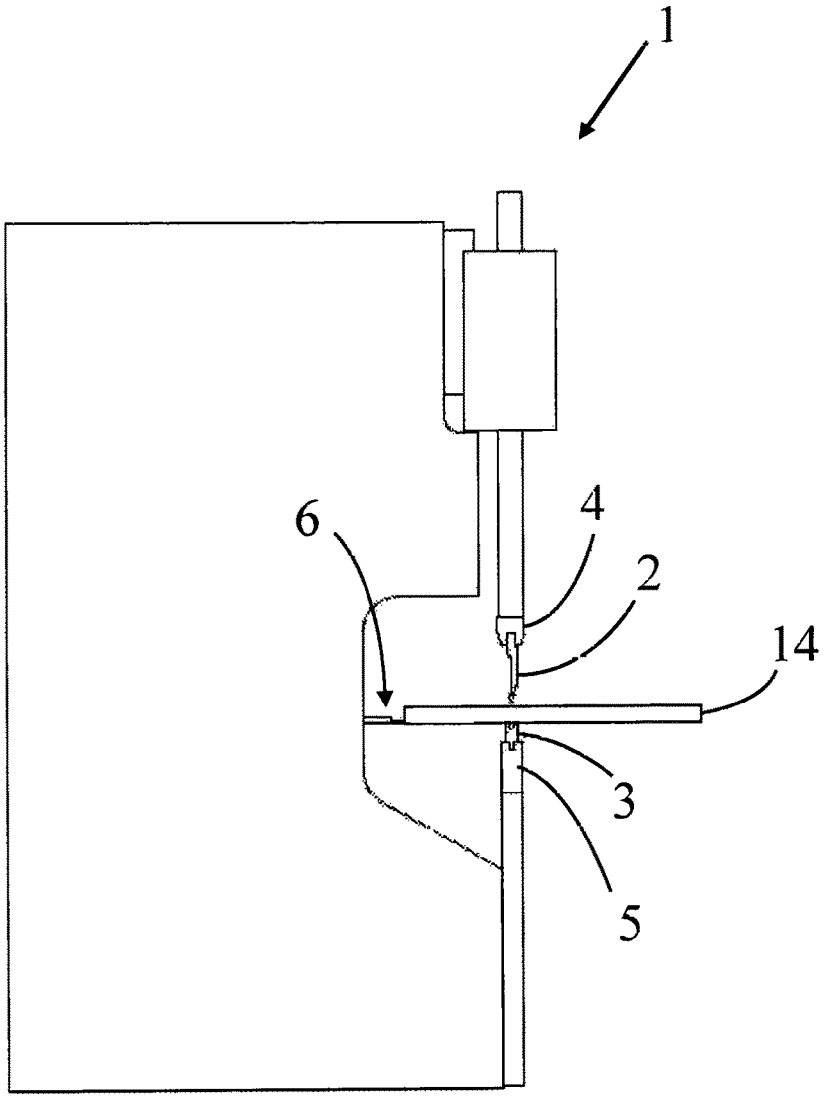
FIG. 2 depicts the bending press from FIG. 1 in side view.

As can be seen from the side view of FIG. 2, in the present exemplary version this recognizably comprises a rear stop, that is, a stop that, when viewed from the operator side of the bending press 1, is located behind the tools 2, 3. The stop 6 serves to position the workpiece 14, for example a sheet to be bent, relative to the tools 2, 3. The rear stop is movable parallel to the bending line (along the Z-axis). The sensor device 8 is located on the rear stop and can be moved together with the rear stop parallel to the bending line.

In an alternative version, the sensor device 8 could be moved independently of the rear stop, for example sitting in its own holder. Preferably, however the sensor device is disposed in the region of the rear stop.

Figure 3:
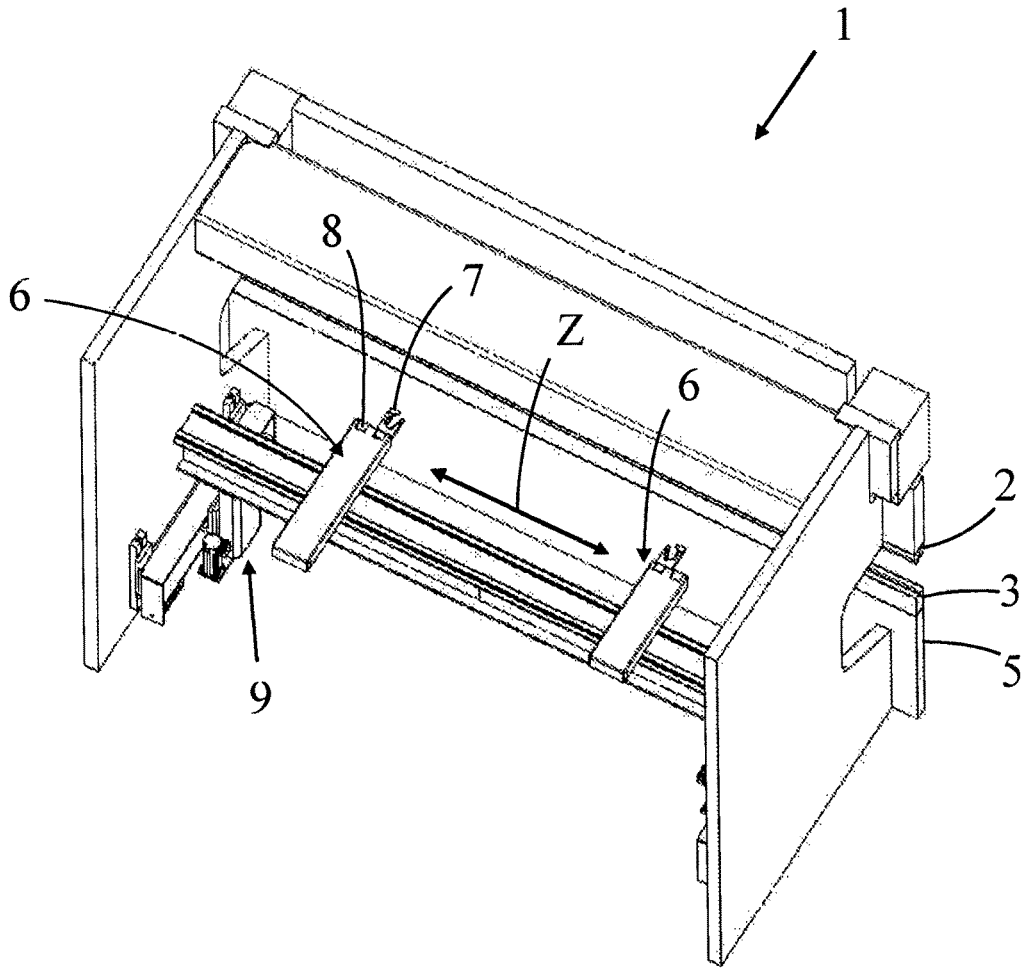
FIG. 3 depicts the bending press from FIG. 1 from behind.
Figure 4:
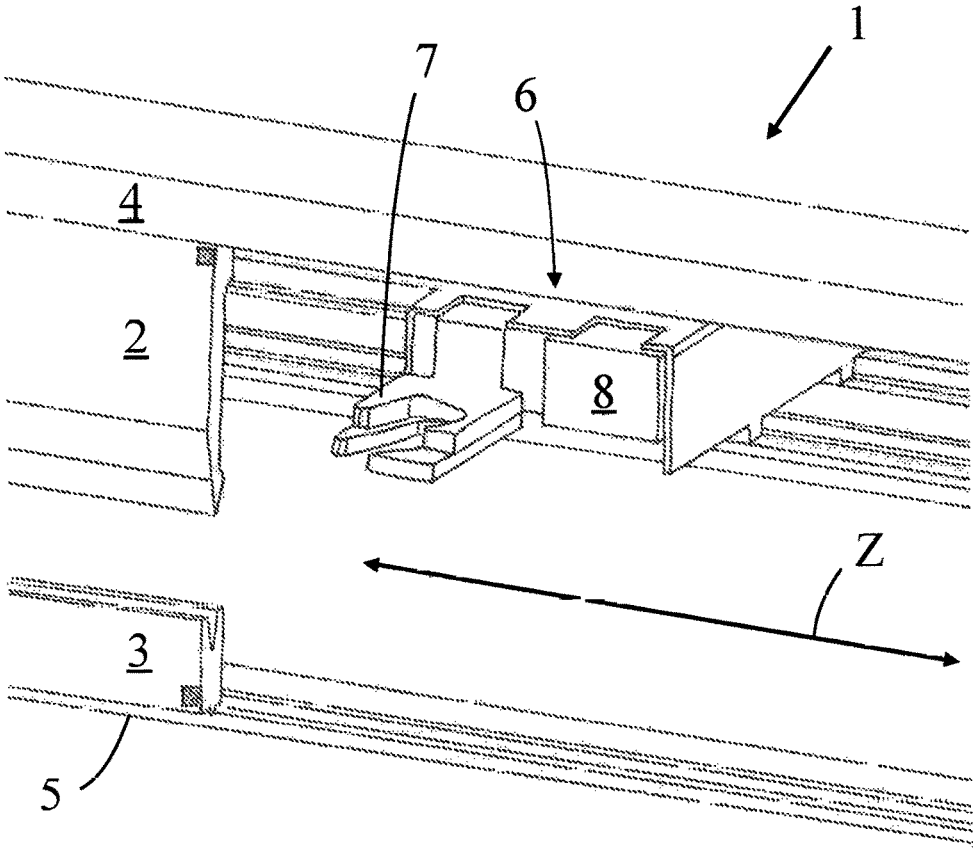
FIG. 4 depicts a detailed section of a bending press from the front, with upper and lower tool and the stop.

In the version shown, the stop 6 includes stop fingers 7 that are additionally movable. Located next to the stop fingers 7 is a sensor device 8 based on a non-contact measurement principle, in particular in the form of a camera. The sensor device 8 is configured for non-contact detection of the position of the upper tool 2 and lower tool 3 inside the bending press 1. The stop 6 can be seen in detail in FIGS. 3 and 4.

In the version described here, the sensor device 8 detects the position of the tools 2, 3 in the direction along the Z-axis, that is, along the bending line. This measurement can be made by detecting the position of a tool 2, 3 relative to the respective tool holder 4, 5 in which the tool 2, 3 is fixed.

Figure 8:
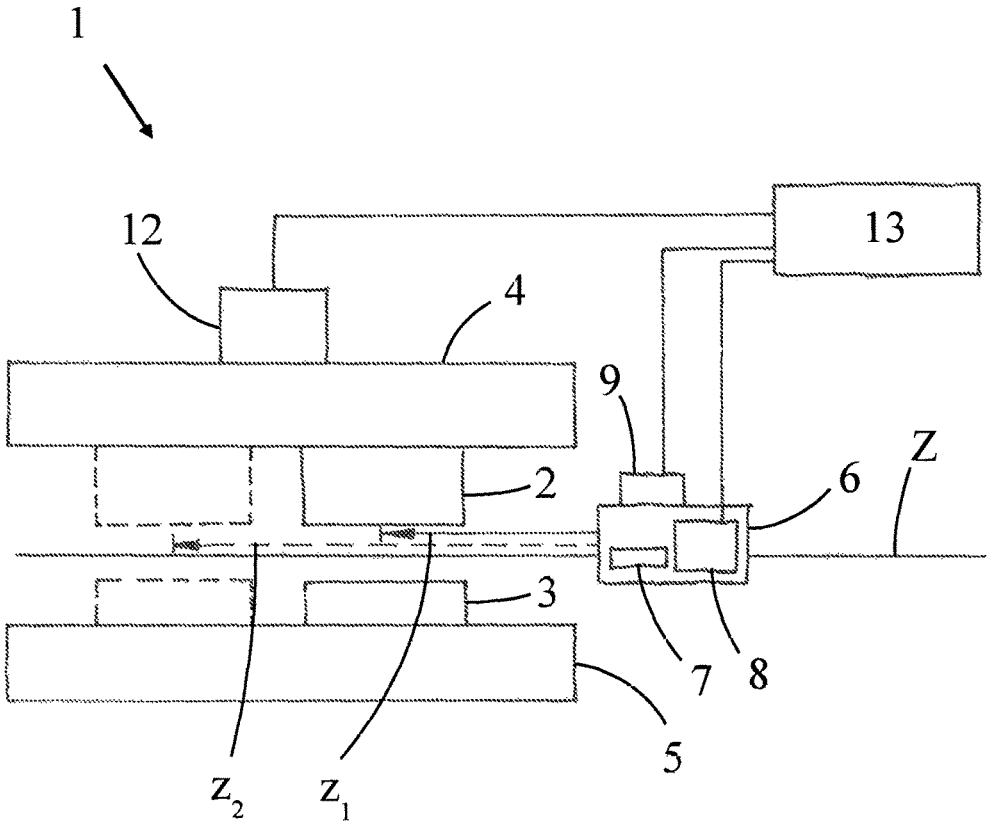
FIG. 8 depicts a schematic view of a bending press with control lines and travel paths; and, FIG. 9 depicts a schematic view of a link of the sensor device to an operator interface of the bending press.

FIG. 8 depicts in schematic view the functional relationships in a bending press 1 which also includes a control device 13 for controlling the bending press 1. The control device 13 in particular controls the drive 12 for the upper tool 2 and therefore the actual pressing process. A further control line connects the control device 13 to the drive 9 for the stop 6. The sensor device 8 is also connected to the control device 13.

The control device 13 is now configured to adapt the movement process by which the at least one stop 6 is positioned relative to the tools 2, 3 depending on the position of the upper tool 2 and the lower tool 3 detected by the sensor device 8.

In FIG. 8, two possible positions of upper tool 2 and lower tool 3 are depicted as an example, one of which is indicated by a dashed line. For the first position (continuous line) a travel path $z_1$ is calculated as a function of the position in order to align the stop 6 in relation to the tools 2, 3. In this case, —as shown—the stop 6 need not necessarily come to rest behind the tool but other positions relative to the tool are also feasible according to the bending plan.

For the second position (dashed line) a travel path $z_2$ is calculated as a function of the position in order to align the stop 6 in relation to the tools. By means of this position the approach coordinates of the stop 6 are adapted to the respective position of the tool, so that a corresponding bending process may be executed according to the bending plan. The adapting or adaptation of the movement process can naturally also relate to the movements of the stop fingers 7.

Also—as indicated in FIG. 6—a plurality of tools can sit in one tool holder whereby a plurality of bending line sections are defined. The bendings associated therewith can be transferred simultaneously or consecutively to the workpiece. In this case, the approach coordinates of the stop 6 are adapted automatically.

Figure 7:
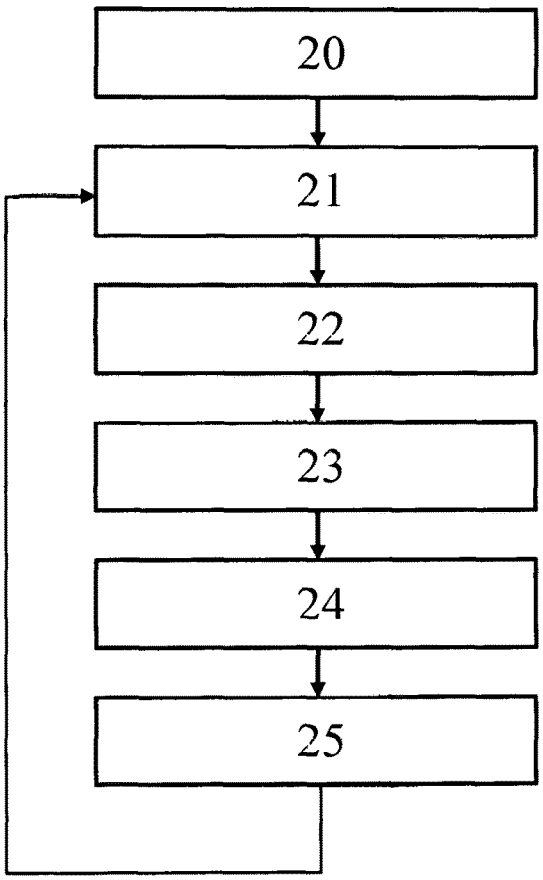
FIG. 7 schematically depicts a possible process sequence in the manner of a flow diagram.

The method for bending a workpiece with a bending press 1 can now comprise the following steps which are shown in the flow diagram of FIG. 7:

Step 20: equipping the bending press with at least one upper tool and/or at least one lower tool which is/are fixed within the respective tool holder.

Step 21: detecting the position of the upper tool 2 and/or lower tool 3 which are fixed in the respective tool holders 4, 5 within the bending press 1 by the sensor device 8. For example, the sensor device 8 can be moved parallel to the bending line (i.e. along the Z-axis) before and/or during the step 21.

Step 22: adapting the movement process via which the at least one stop 6 is positioned relative to the tools 2, 3 depending on the position of the upper tool 2 and/or lower tool 3 detected by the sensor device 8. This step may be accomplished, for example, by calculating a travel path $z_1$, $z_2$ of the stop 6 parallel to the bending line (i.e. along the Z-axis).

Step 23: positioning the at least one stop 6 according to the adapted movement process by moving the stop 6 via a drive 9 controlled by the control device 13 relative to the tools 2, 3.

Step 24: performing a bending process by relative movement of upper tool 2 and/or lower tool 3.

Step 25: exchanging and/or adding upper and/or lower tools and the fixing thereof in the respective tool holder.

Steps 21 to 25 may then be repeated.

Preferably the position of the upper tool 2 and the position of the lower tool 3 located at the same height are detected simultaneously. To this end, the sensor device 8 can be moved into a position in which the detection range of the sensor device 8 covers both the upper tool 2 and also the lower tool 3 at least partially.

Figure 5:
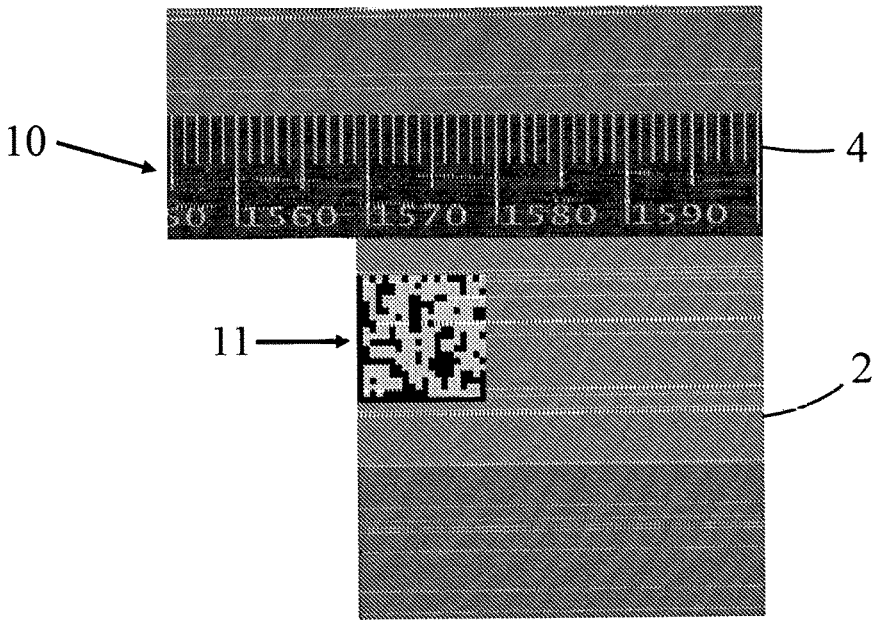
FIG. 5 depicts an upper tool which is fixed in a tool holder.

FIGS. 5 and 6 show preferred variants in which a scale 10 is applied to the respective tool holder 4, 5. Alternatively or additionally, a scale could also be applied to the upper tool 2 and/or the lower tool 3.

In this version, the detecting or the detection of the position of the upper tool 2 and/or the lower tool 3 can be made with the aid of a scale 10. To this end, image recordings of the sensor device 8 configured as a camera are evaluated in view of the relative position of the tool in relation to the scale (e.g., by using appropriate image recognition software). As can be seen from FIGS. 5 and 6, the scale division extends parallel to the bending line.

Preferably, the detection of the position of the upper tool 2 and/or the lower tool 3 is made by contour recognition of the tool 2, 3 by employing appropriate image processing programs.

In a preferred variant, a two-dimensional code 11, in particular a data matrix code (comprising an arrangement of black and white rectangles inside a field) is applied to the upper tool 2 and the lower tool 3. The code 11 contains information about the tool 2, 3 used, in particular about type and dimensions of the tool 2, 3.

Advantageously one code 11 each is applied to the front side and to the rear side of a tool 2, 3. Consequently, the tool 2, 3 can also be inserted in a mirror-inverted manner into a tool holders 4, 5 and detected simply by the sensor device 8.

In this version, the code information can also be read out by the sensor device 8. It can subsequently be checked whether a tool complies with predefined specifications or is compatible with the bending plan.

Figure 9:
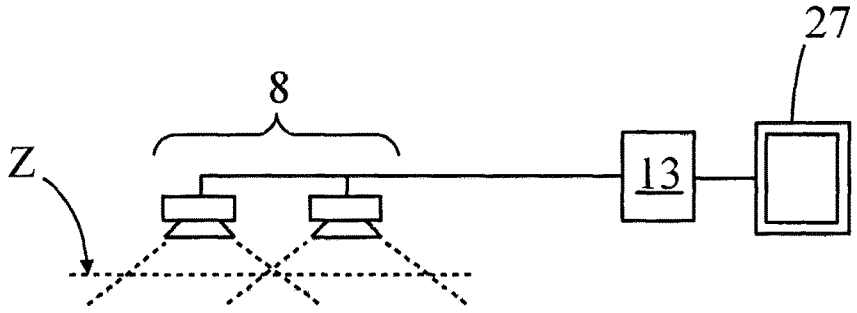

FIG. 9 depicts a version in which the sensor device 8 includes two non-contact sensors with different spatial detection ranges. The sensors here are optical sensors, in particular cameras. The cameras image different regions along the bending line Z (also called Z-axis). The detection ranges of the sensors may overlap in this case.

It can furthermore be seen from FIG. 9 that the bending press includes an operator interface 27 (here in the form of a screen) that is connected to the control device 13 or the sensor device 8. Here, sensor data of the sensor device 8 and/or data derived from the sensor data can be shown on the operator interface 27. These data can be output automatically to the operator interface 27 during operation.

The sensor device 8 may also include only one sensor or camera. In particular, the images or image sequences recorded with the camera can be displayed on the operator interface 27.

In a preferred method, it can be displayed on the operator interface 27 when the position of the upper tool 2 and/or lower tool 3 detected by means of the sensor device 8 is not correct, in particular when the tools 2, 3 are not aligned with one another. As a result of this information, which may already contain correction values, it is possible for the operator to correct the position of the tools 2, 3 in a simple manner.

The invention is not merely restricted to the described exemplary versions and the aspects emphasized therein. On the contrary, a multiplicity of modifications are possible which lie within the framework of technical disclosure and action. It is also possible to achieve further versions by combining the elements and features without departing from the scope of claimed protection.

LIST OF REFERENCE LABELS

1 Bending press
2 Upper tool
3 Lower tool
4 Tool holder for upper tool 2
5 Tool holder for lower tool 3
6 Stop
7 Stop finger
8 Sensor device
9 Drive for stop 9

10 Scale
11 Code
12 Drive for upper tool 2
13 Control device
14 Workpiece
20-26 Process steps
27 Operator interface
Z Bending line

What is claimed is:

1. A bending press comprising:
an upper tool;
a first tool holder configured to hold said upper tool;
a lower tool;
a second tool holder configured to hold said lower tool;
a workpiece-positioning stop movably mounted relative to said upper and lower tools;
a drive operatively connected to said workpiece-positioning stop to controllably position said workpiece-positioning stop relative to said tools;
a sensor configured to detect, respectively for each of said upper and lower tools, at least one respective tool parameter selected from the group of tool parameters consisting of tool position and tool type; and,
a controller in operative communication with said drive, said controller being in operative communication with said sensor to receive therefrom, respectively for each of said upper and lower tools, detected respective values of the at least one tool parameter, said controller having electronic circuitry and programmed instructions that control said drive to controllably position said workpiece-positioning stop relative to said upper and lower tools depending on at least one detected respective value of the at least one tool parameter respectively for each of said upper and lower tools.

2. The bending press as claimed in claim 1, wherein:
said workpiece-positioning stop is a rear stop movably mounted for movement parallel to a bending line; and,
said sensor is disposed in a region of said workpiece-positioning stop.

3. The bending press as claimed in claim 1, wherein:
said sensor is disposed on said workpiece-positioning stop, and said workpiece-positioning stop is movably mounted for movement parallel to a bending line.

4. The bending press as claimed in claim 1, wherein:
said sensor has a detection range; and,
said sensor is movably mounted to attain at least one operational position where its detection range covers said upper tool and covers at least in-part said lower tool.

5. The bending press as claimed in claim 1, wherein:
said sensor is a camera.

6. A bending press as claimed in claim 1, further comprising:
at least one scale situated on at least one of said upper and lower tools.

7. A bending press as claimed in claim 1, further comprising:
at least one position marking situated on at least one of said first and second tool holders.

8. A bending press as claimed in claim 1, further comprising:
at least one two-dimensional code situated on at least one of said upper and lower tools, said at least one two-dimensional code yielding to said sensor feedback about tool type and tool dimensions.

9. A process for bending workpieces with a bending press, comprising the steps of:
fixing upper and lower tools in respective upper and lower tool holders;
detecting with a sensor at least one tool parameter selected from the group of tool parameters consisting of tool position and tool type;
automatically controlling the movement of a workpiece-positioning stop relative to the upper and lower tools, based on the at least one tool parameter from the group of tool parameters consisting of tool position and tool type;
automatically positioning the workpiece-positioning stop with a drive motor by said step of automatically controlling the movement of a workpiece-positioning stop relative to the upper and lower tools based on the at least one tool parameter from the group of tool parameters consisting of tool position and tool type; and,
bending a workpiece by relative movement of the upper and lower tools relative to one another.

10. A process for bending workpieces with a bending press as claimed in claim 9, further comprising the step of:
detecting a respective position of at least one of said upper and lower tools relative to its respective tool holder, during said step of detecting with the sensor at least one tool parameter from the group of tool parameters consisting of tool position and tool type.

11. A process for bending workpieces with a bending press as claimed in claim 9, further comprising the step of:
electronically calculating the workpiece-positioning stop displacement path parallel to a bending line, during said step of automatically controlling the movement of the workpiece-positioning stop relative to the upper and lower tools based on the at least one tool parameter from the group of tool parameters consisting of tool position and tool type.

12. A process for bending workpieces with a bending press as claimed in claim 9, further comprising the step of:
moving the sensor parallel to a bending line.

13. The process for bending workpieces with a bending press as claimed in claim 9, wherein:
said step of detecting with the sensor at least one tool parameter selected from the group of tool parameters consisting of tool position and tool type includes, (a) detecting with the sensor at least one tool parameter of the upper tool selected from the group of tool parameters consisting of tool position and tool type and simultaneously, (b) detecting with the sensor at least one tool parameter of the lower tool selected from the group of tool parameters consisting of tool position and tool type.

14. A process for bending workpieces with a bending press as claimed in claim 9, further comprising the step of:
automatically detecting a tool position using at least one position indicator selected from the group of position indicators consisting of a scale and a position marking.

15. The process for bending workpieces with a bending press as claimed in claim 9, wherein:
said step of detecting with the sensor at least one tool parameter selected from the group of tool parameters consisting of tool position and tool type includes contour recognition of the tool.

16. A process for bending workpieces with a bending press as claimed in claim 9, further comprising the step of:
automatically reading at least one two-dimensional code associated with a tool.

17. A process for bending workpieces with a bending press as claimed in claim 9, further comprising the step of:

automatically providing a tool misalignment indication when the upper and lower tools are not aligned with one another.

18. A process for bending workpieces with a bending press as claimed in claim 9, further comprising the step of:

calibrating the position of the workpiece-positioning stop using an optically-readable position mark.

19. A process for bending workpieces with a bending press as claimed in claim 9, further comprising the steps of:

reading a workpiece-attached code; and, controlling the bending of the workpiece based on said step of reading the workpiece-attached code.

20. A process for bending workpieces with a bending press as claimed in claim 9, further comprising the steps of:

including a camera at the sensor; and, electronically returning images recorded with the camera to an operator interface.

* * * * *